US007055727B2

(12) United States Patent
Rohrmoser et al.

(10) Patent No.: US 7,055,727 B2
(45) Date of Patent: Jun. 6, 2006

(54) SETTING TOOL

(75) Inventors: Guenter Rohrmoser, Meiningen (AT); Robert Jakob, Feldkirch (AT); Stefan Boenig, Achberg-Esseratsweiler (DE)

(73) Assignee: Hilti Aktiengesellschaft, Schaan (LI)

( * ) Notice: Subject to any disclaimer, the term of this patent is extended or adjusted under 35 U.S.C. 154(b) by 39 days.

(21) Appl. No.: 10/932,447

(22) Filed: Sep. 2, 2004

(65) Prior Publication Data

US 2005/0051591 A1 Mar. 10, 2005

(30) Foreign Application Priority Data

Sep. 5, 2003 (DE) ..... 103 41 384

(51) Int. Cl.
*B25C 1/14* (2006.01)

(52) U.S. Cl. ..... 227/10; 227/156

(58) Field of Classification Search ..... 227/10, 227/156, 130; 267/149, 152
See application file for complete search history.

(56) References Cited

U.S. PATENT DOCUMENTS

| | | | | |
|---|---|---|---|---|
| 2,845,908 | A * | 8/1958 | Maier | 60/638 |
| 2,879,986 | A * | 3/1959 | Maier | 267/149 |
| 3,490,673 | A * | 1/1970 | Diehl | 227/10 |
| 4,222,462 | A * | 9/1980 | Ottestad | 188/67 |
| 4,824,003 | A * | 4/1989 | Almeras et al. | 227/10 |
| 5,553,764 | A * | 9/1996 | Remerowski | 227/10 |
| 6,085,958 | A * | 7/2000 | Kersten | 227/10 |
| 6,182,881 | B1 * | 2/2001 | Kellner et al. | 227/10 |
| 6,273,199 | B1 * | 8/2001 | Kiikka et al. | 173/1 |
| 6,679,411 | B1 * | 1/2004 | Popovich et al. | 227/10 |

* cited by examiner

*Primary Examiner*—Scott A. Smith
(74) *Attorney, Agent, or Firm*—Abelman, Frayne & Schwab

(57) ABSTRACT

A setting tool for driving fastening elements includes a piston device (30) for the setting piston (20) and arranged in a setting direction end region of the hollow chamber (14) of the piston guide (13), with the piston stop device (30) having a stop member (32) adjoining the hollow chamber (14) in the setting direction and including a leadthrough (33) having an inner conical active surface (34) that cooperates with the conical active surface (24) of the setting piston (20), and with at least one of the active conical surface (24) and the active conical surface (34) being provided with a friction-reducing coating (35).

6 Claims, 1 Drawing Sheet

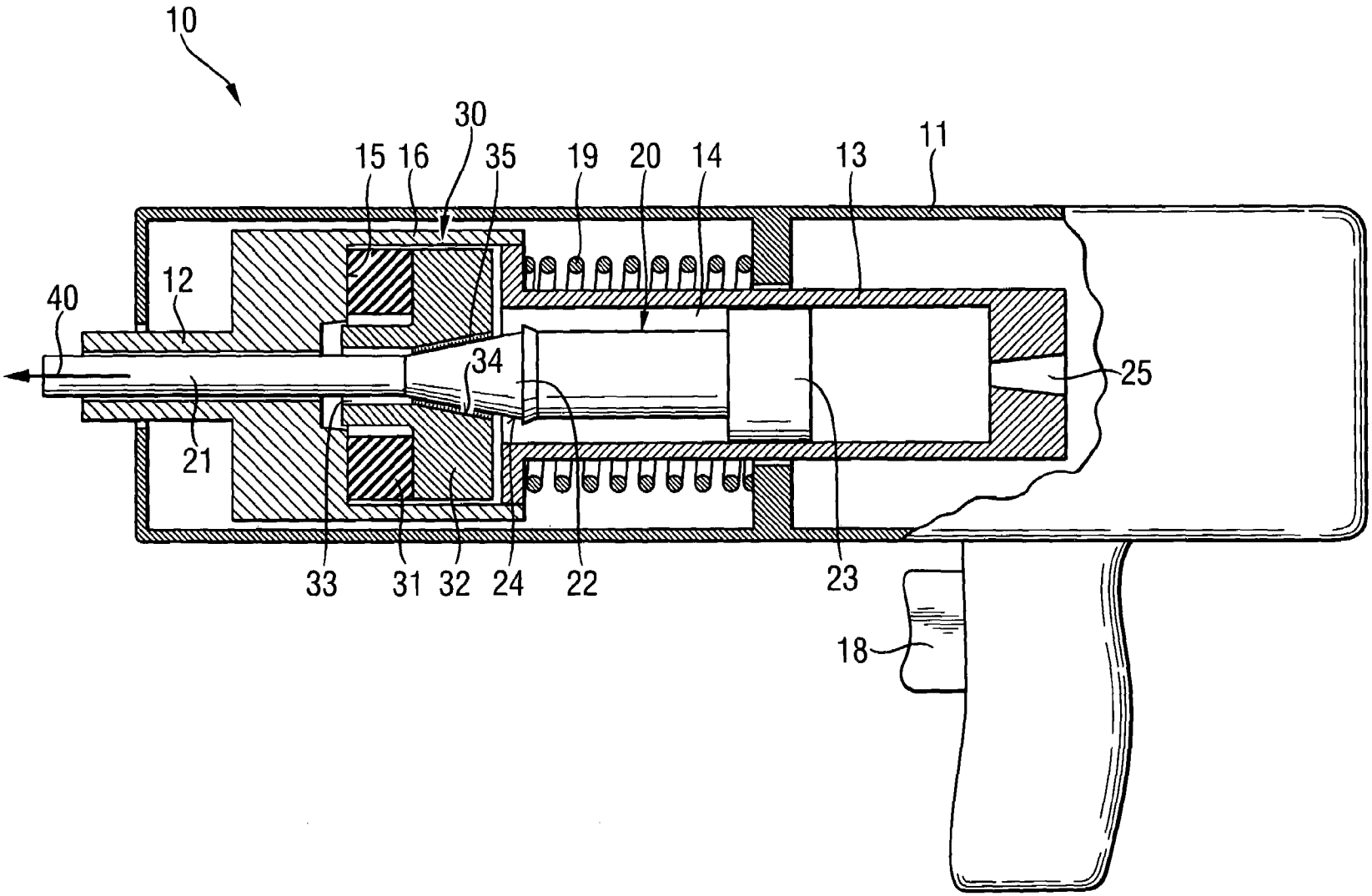
10
11
12
13
14
15
16
18
19
20
21
22
23
24
25
30
31
32
33
34
35
40

SETTING TOOL

BACKGROUND OF THE INVENTION

1. Field of the Invention

The present invention relates to a setting tool for driving in fastening elements and including a piston guide having a hollow chamber, a setting piston axially displaceably arranged in the hollow chamber of the piston guide and having a piston head, a piston stem, and a conical active surface, and a piston stop device for the setting piston and arranged in a setting direction end region of the hollow chamber, with the piston stop device having a stop member adjoining the hollow chamber in the setting direction and having a conical active surface that cooperates with the conical active surface of the setting piston.

2. Description of the Prior Art

Setting tools of the above-described type are driven with solid, gaseous, or fluid fuels or with compressed air. In combustion-driven setting tools, the setting piston is driven by combustion gases. With these setting tools, fastening elements, such as, e.g., nails or bolts are driven in constructional components.

U.S. Pat. No. 4,828,003 discloses a setting tool in which between the piston guide and the bolt guide, there are arranged one after another a rigid ring and an elastic ring. In the elastic ring, a further rigid ring is arranged that limits the stroke of the first rigid ring. The first rigid ring has a leadthrough conically narrowing in the setting direction for the piston stem. The setting piston has, adjacent to the first rigid ring, a conical surface, with the conical profile of the conical surface of the setting piston and the conical surface of the leadthrough being complementary to each other.

The drawback of the structure of the above-discussed U.S. patent consists in that under certain operational conditions, the setting piston with its conical surface can be jammed in the conical leadthrough of the first rigid ring. Such jamming often leads to breakdown of the setting tool parts and to interruptions of the operation of the setting tool as after a while, release of jamming is not possible.

Accordingly, an object of the present invention is to provide a setting tool in which the drawback of the setting tool of the above-mentioned U.S. patent is eliminated, i.e., jamming between the setting piston and the stop ring is prevented.

SUMMARY OF THE INVENTION

This and other objects of the present invention, which will become apparent hereinafter are achieved by providing at least one of the conical active surface of the setting tool and the conical active surface of the stop member with a friction-reducing coating. This prevents jamming of the setting piston in the stop ring. Thereby, the service life of both the stop member and the setting piston is noticeably increased.

According to an advantageous embodiment of the present invention, the coating is essentially non-compressible. Thereby, the service life of the coating is increased, and it is capable to prevent jamming.

Preferably, the coating has a sliding friction coefficient equal to or less than 0.10. With such a coefficient, a noticeable reduction of friction between the conical active surface of the stop member and the setting piston is achieved.

Advantageously, the coating has a thickness of from 1 to 20000 nm, which insures a cost-effective manufacturing of the stop member and the setting piston and an increase of their service life.

Advantageous coatings with good operational characteristics are formed of zinc, Teflon (PTFE), or nickel-teflon.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

The drawings show:

Single FIGURE shows a partially cross-sectional side view of a setting tool according to the present invention with a piston stop device.

DETAILED DESCRIPTION OF THE PREFERRED EMBODIMENT

A setting tool 10 according to the present invention, which is shown in the drawing, has a one-or multi-part housing 11, a piston guide 13 arranged in the housing 11, and a setting piston 20 displaceably arranged in hollow chamber 14 of the piston guide 13. The setting piston 20 is driven by a propellant or by products of its reaction, e.g., by combustion gases, etc.

The setting piston 20 has a piston stem 21 and a piston head 23 provided at the rear, in the setting direction 40, end of the stem 21. Spaced from the piston head 23, there is provided, on the stem 21, a band 22. The band 22 is adjoined by a active surface 24 extending in the direction of the piston stop device 30. Alternatively to the arrangement shown in the drawings, the band 22 can be arranged in the setting direction region of the piston head 23. The piston guide 13 is displaceably arranged in the sleeve-shaped housing 11 and is supported against a spring 19. At the end of the piston guide 13 facing in the direction opposite the setting direction 40, there is arranged a cartridge socket 25 for receiving a propellant, e.g., in form of a catridge, pellet, or blister. In the setting direction 40, the piston guide 13 adjoins a bolt guide 12 into which is brought, before start of a setting process, a fastening element such as a nail, a bolt, and the like. On the bolt guide, a magazine for fastening elements, not shown, can be arranged.

The setting process can only then be effected with the setting tool 10 when the bolt guide 12, which is located in front of the piston guide 13, is pressed against an object, not shown, against a biasing force of the spring 19. For actuating the setting tool 10, there is provided thereon an actuation switch 18.

Between the bolt guide 12 and the piston guide 13, there is arranged the piston stop device 30 which serves for stopping the setting piston 20 when the piston 20 moves with excessive energy or when the piston 20 should be braked because of a faulty set-up, e.g., when there is no fastening element in the bolt guide 12. The piston stop device 30 is supported against a stop 15 which is formed as a bottom of a sleeve section 16 of the bolt guide 12. The piston device 30 has a damping element 31 which is formed in the embodiment shown in the drawing as an elastomeric ring, and a stop member 32 which is formed as a sleeve part or a thrust piece. The damping element 31 can be vulcanized on the stop member 32, and it is arranged between the stop member 32 and the stop 15. The damping element 31 supports the stop member 32 against the stop 15 in a damping manner. The stop member 32 has a leadthrough 33 through which the stem 21 of the setting piston 20 is displaceable and which is provided with a conical active surface 34. The inclination of the annular conical surface 34 corresponds to the inclination of the conical active surface 24 provided on the setting piston 20. The conical active surface 24 of the setting piston 20 cooperates with active conical surface 34 of the leadthrough 33 in case of a faulty set-up. The conical active surface 34 is provided with a coating 35 formed of zinc and having a low frictional resistance. The coating 35 prevents jamming of the setting piston 20 with its conical active surface 24 in the leadthrough 33 in any setting cituation. The coating 35 functions as parting means that prevents cold welding between the stop member 32 and the setting piston 20. The thickness of the coating 35 can amount, e.g., from 1 to 20000 nm.

Besides zinc, other materials can be used for forming the coating which have a low coefficient of μ of sliding friction, preferably, $\mu \leqq 0.10$(dry). The following materials are suitable, e.g., for forming the coating 35, namely, Teflon (PTFE) nickel-Teflon dispersion layers, Teflon-graphite, Teflon-molybdenum sulfide, hard crome diffusion, fluopolymers, such as e.g., PFA, titanium-aluminum-nitrite (TiAlN), tungsten carbide, diamond-like carbon (DLC), polycrystalline diamond layers, and chemical or galvanic nickel layers.

Likewise, the conical active surface 24 of the setting piston 20 can be provided with a coating instead of forming the coating on the conical active surface 34. Also, both conical active surfaces 24 and 34 can be provided with a coating.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A setting tool for driving in fastening elements, comprising:

a piston guide (13) having hollow chamber (14);

a setting piston (20) axially displaceably arranged in the hollow chamber (14) of the piston guide (13) and having a piston head (23), a piston stem (21), and a conical active surface (24); and a piston stop device (30) for the setting piston (20) and arranged in a setting direction end region of the hollow chamber (14), the piston stop device (30) having a stop member (32) adjoining the hollow chamber (14) in the setting direction and including a leadthrough (33) having an inner conical active surface (34) that cooperates with the conical active surface (24) of the setting tool piston (20), at least one of the conical active surface (24) and the active conical surface (34) being provided with a friction-reducing coating (35) having a thickness of from 1 to 20000 nm.

2. A setting tool according to claim 1, wherein the coating (35) is substantially non-compressible.

3. A setting tool according to claim 1, wherein the coating (35) has a sliding friction coefficient $(\mu) \leqq 0.10$.

4. A setting tool according to claim 1, wherein the coating (35) consists of PTFE.

5. A setting tool according to claim 1, wherein the coating (35) consists of PTFE-nickel.

6. A setting tool according to claim 1, wherein the coating consists of zinc.

* * * * *